US006343564B1

(12) United States Patent
Miller et al.

(10) Patent No.: US 6,343,564 B1
(45) **Date of Patent: *Feb. 5, 2002**

(54) AMMUNITION DETECTOR

(75) Inventors: J. Scott Miller; Gerald D. Gravdahl, both of Brooklyn Park; Rodney D. Moser, New Hope, all of MN (US)

(73) Assignee: Alliant Techsystems Inc., Edina, MN (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/360,756

(22) Filed: Jul. 26, 1999

(51) Int. Cl.[7] ..... G01D 5/00

(52) U.S. Cl. ..... 116/281; 116/283

(58) Field of Search ..... 116/227, 281, 116/283; 206/459.1

(56) References Cited

U.S. PATENT DOCUMENTS

| | | | | | |
|---|---|---|---|---|---|
| 4,572,097 | A | * | 2/1986 | Chapelsky | 116/227 |
| 4,831,877 | A | * | 5/1989 | Snow | 73/290 R |
| 4,852,451 | A | * | 8/1989 | Rogers | 73/149 |
| 4,941,268 | A | * | 7/1990 | Tausk | 116/227 |
| 4,944,396 | A | * | 7/1990 | Larkin | 116/283 |
| 5,088,323 | A | * | 2/1992 | Johnson et al. | 73/290 R |
| 5,353,514 | A | | 10/1994 | McMurty | 33/559 |
| 5,398,590 | A | * | 3/1995 | Snyder, Sr. | 89/33.16 |
| 5,616,157 | A | * | 4/1997 | Mead et al. | 116/283 |

* cited by examiner

*Primary Examiner*—Diego Gutierrez
*Assistant Examiner*—Yaritza Guadalupe
(74) *Attorney, Agent, or Firm*—George A. Leone

(57) ABSTRACT

A self-contained ammunition round detection unit includes a housing with an indicator mounted within the housing. A probe is coupled to the indicator. A dual set of biasing elements are captivated within the housing. The dual set of biasing elements cooperate to retract the indicator in a biased state, and extend the indicator to indicate an ammunition round is present when the probe is at least partially retracted by contacting a surface of the ammunition round.

20 Claims, 5 Drawing Sheets

AMMUNITION DETECTOR

FIELD OF THE INVENTION

The present invention is generally related to product detectors, and, in particular, to an ammunition detector for indicating the presence of an ammunition round in a storage canister.

BACKGROUND OF THE INVENTION

Tank ammunition rounds are typically stored in individual shipping and storage canisters. When stored, up to about 30 such canisters are kept secured onto a single pallet. Since the shipping and storage canisters are recyclable, they are monitored for inventory purposes. In order to facilitate inventory tracking, full canisters are often loaded on the same pallet with empty canisters. Currently, there is no way to discern an empty canister from a loaded canister, except by opening the canister cover and visually inspecting the interior.

Unfortunately, there are significant drawbacks to visually inspecting for product. One such drawback is that most shipping and storage canisters are covered with an airtight seal. The airtight seal makes it cumbersome to remove the cover. Further, visual inspection of large canisters stacked high on a pallet is inherently awkward and time consuming. The inspector must literally look high and low, while pulling and replacing covers, until the inspection is complete. Further still, such inspections are inherently unreliable since there is no visible means of verifying the inspection results once all the covers have been replaced on an inspected pallet of containers.

SUMMARY OF THE INVENTION

The present invention provides a product detector having a top housing, where the top housing includes a top bore and a bottom bore. An indicator pin assembly tube is attached to the top housing. An indicator pin assembly has a top portion captively engaged to the top housing. The indicator pin assembly further includes an indicator button located at a top end, a first biasing device, and a probe. A first biasing device and the probe are captively engaged in the indicator pin assembly tube. The probe is slidingly engaged to the indicator button such that, when the probe is extended in a biased state, the indicator button is retracted, thereby also retracting the indicator cap. A second biasing mechanism is captivated within the indicator cap. The first and second biasing mechanisms cooperate to retract the indicator cap and extend the probe in the biased state.

It is a motivation of the present invention to provide an ammunition product canister detector that eliminates the need for removing a canister cover to determine the contents.

It is a further motivation of the invention to provide a detection device that mounts in a canister cover and contacts a product inside the canister.

It is a further motivation of the invention to provide a detection device where an indicator pin pops out if a product is contained within a canister, and is retracted if the canister is empty.

It is a further motivation of the invention to provide a detection device for an ammunition container that maintains an airtight seal in the container.

It is a further motivation of the present invention to provide a self-contained product detection unit that needs no external wires or mechanisms to detect product presence. An indicator protrudes from the detector when a product is present and a probe extends itself until a product is contacted. In a preferred embodiment, the movement of these two pieces is controlled by a dual set of biasing springs. One spring pushes the indicator pin out to indicate product and another spring returns the probe to an empty position. The location of the indicator pin is determined by the position of the product probe. The indicator pin and product probe are coupled by a connecting device. The connecting device allows the probe a much greater travel than the indicator pin. The greater travel of the probe detects a number of different products, of different lengths in a canister, yet the indicator pin only travels a predetermined distance. The predetermined distance is set to keep the indicator pin from protruding an excessive amount that could present a hazard. It also allows the button to be at a uniform height for ease of product determination.

Other objects, features and advantages of the present invention will become apparent to those skilled in the art through the description of the preferred embodiment, claims and drawings wherein like numerals refer to like elements.

DETAILED DESCRIPTION OF THE PREFERRED EMBODIMENT

Figure 1:
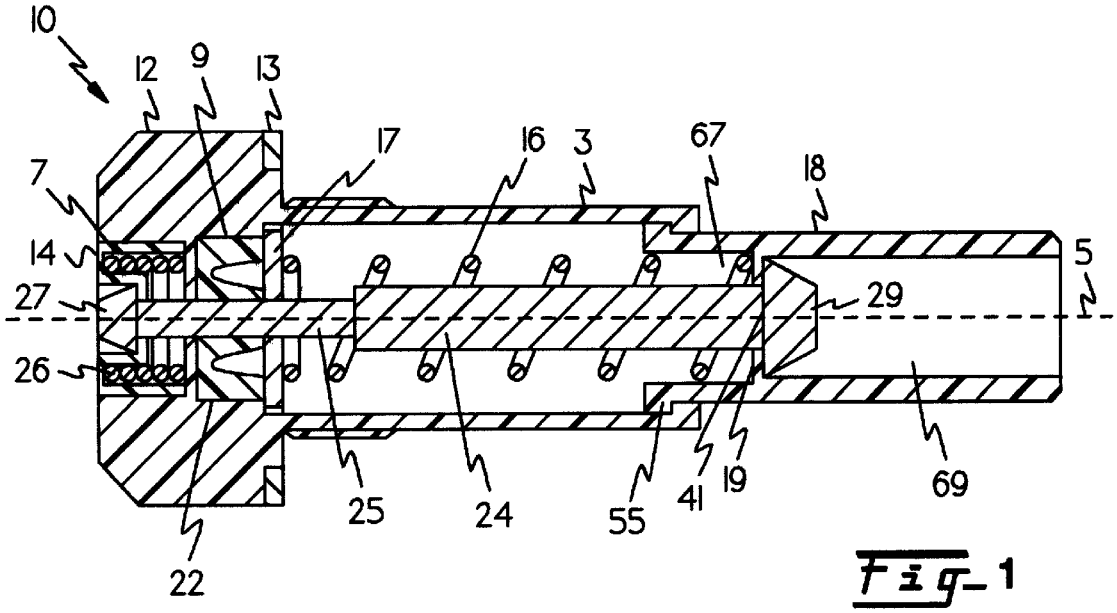
FIG. 1 is a cut away side view of one example of the product detector of the invention in a biased state.

Referring now to FIG. 1, a cut away side view of one example of the product detector of the invention in a biased state is shown. The product detector 10 includes a top housing 12, a first seal 13, an indicator cap 14, a probe spring 16, a probe 18, a second seal 22, an indicator pin 24 and an indicator spring 26. The product detector 10 is generally cylindrical having a central axis 5.

Still referring to FIG. 1, the top housing 12 is preferably constructed of a plastic material. The first seal 13 and second seal 22 preferably comprise rubber. More preferably, the second seal 22 comprises a U-cup seal. Suitable U-cup seals are commercially available. The first seal 13 and second seal 22 are constructed to meet requirements for a maximum leak rate of 5 cc/minute when pressurized to about 3 p.s.i., when measured for at least 5 seconds. The top housing 12 has a top bore 7 through one side and a bottom bore 9 through the opposite end. The top housing 12 and top and bottom bores 7, 9 are substantially axially disposed around the central axis 5.

Referring again to FIG. 1, an indicator pin assembly 55 includes an indicator pin having an indicator button 25, top flared end 27, and bottom flared end 29. The indicator pin assembly also includes probe 18 and probe spring 16. The indicator pin assembly 55 is assembled to the top housing 12 so that the indicator button 25 protrudes through the top and bottom housing bores 7, 9 respectively. The indicator pin 24 with probe spring 16 and probe 18 are captively engaged within indicator pin assembly tube 3. The indicator pin assembly tube 3 is attached by means of a press fit or other known attaching mechanism to the top housing 12, or may alternatively be made integrally to the top housing. The seal 22 is inserted into the bottom bore 9. The indicator cap 14 is positioned in the top bore 7 together with an indicator spring 26. The indicator cap 14 is press fitted or snap fitted onto the top flared end of the indicator pin 24. The indicator spring 26 preferably comprises a standard compression spring having a lower spring constant or spring strength relative to the probe spring 16. The pair of springs operate so that the product detector is biased with the probe 18 extended.

Continuing the description of the indicator pin assembly 55, in one example embodiment, the probe 18 is substantially cylindrical and has a top bore 67 at one end and a bottom bore 69 at a second, opposing end. The top bore 67 stops at surface 19 having an aperture therein. The indicator button 25 includes flared end 29. Flared end 29 is sized to snap fit into the aperture 41 of surface 19 so that the distal end of the indicator pin is captured within the bottom bore 69 of the probe 18. The indicator pin is also inserted through probe spring 16 held between a retainer 17 and the surface 19. The retainer 17 may be a flat annular part that also holds the seal 22 in place. In the absence of a counter force, the probe spring 16 bears against the surface 19 and retainer 17 so as to retract the indicator button 25, thereby also retracting attached indicator cap 14.

Figure 2:
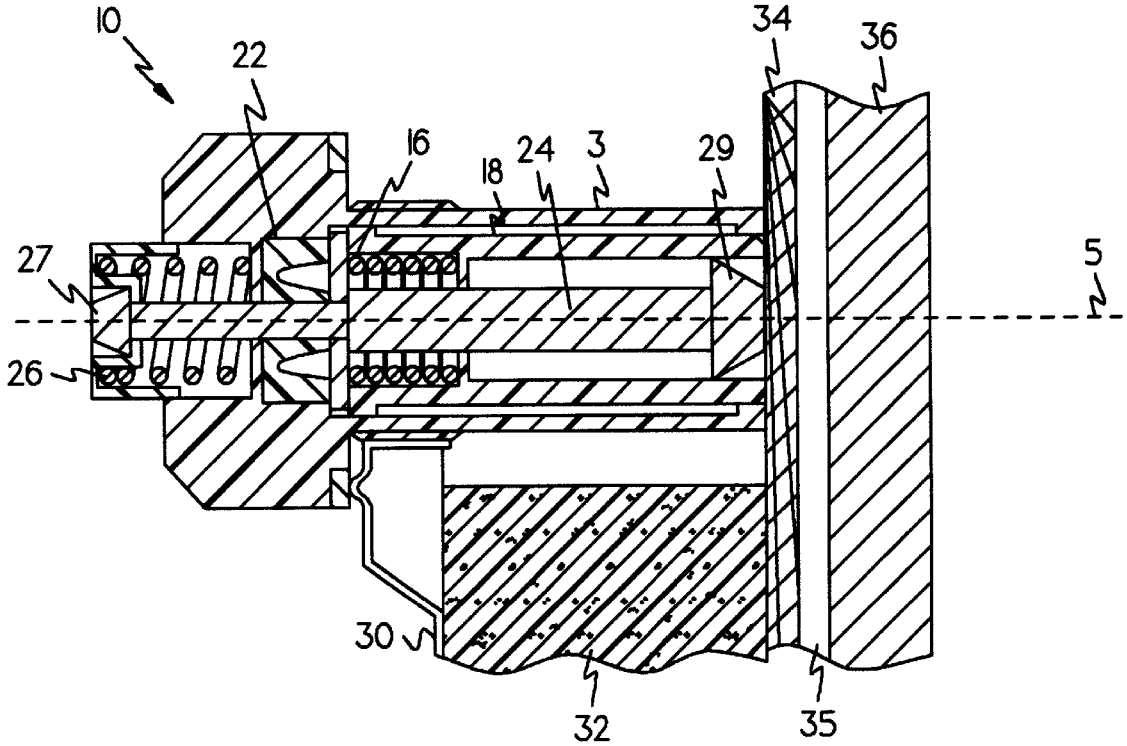
FIG. 2 is a cut away side view of one example of the product detector of the invention in a retracted state.

Referring now to FIG. 2, a cut away side view of one example of the product detector of the invention in a retracted state is shown. The product detector 10 is shown engaged into an ammunition container cover 30. Stacked inside the container atop a cartridge bottom end 36 are a foam cushion 32, a filler member 34, and a spacer 35. When probe 18 partially retracts due to contacting a product surface, the center pin 24 is extended. In operation, retraction of center pin 24 and probe 18 compresses probe spring 16, thereby releasing plunger spring 26 that expands to extend indicator cap 14. The extended indicator cap 14 thus gives a visual indication of the presence of a product in the container. In one example, the indicator cap or button may be distinguished by using an appropriate coloration such as red, green, yellow or other desired color.

Figure 3:
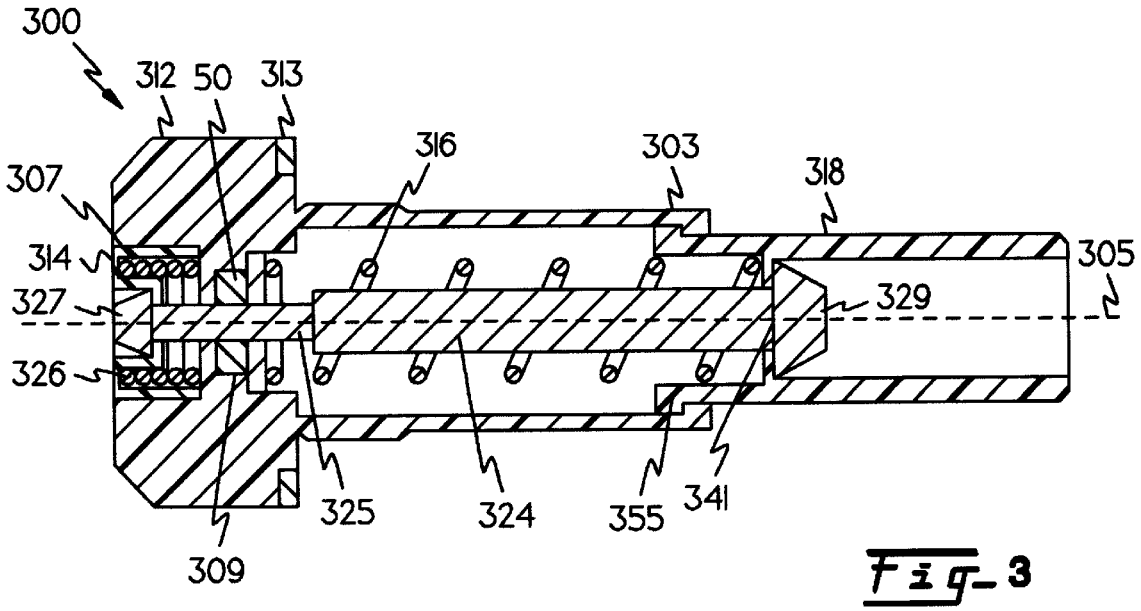
FIG. 3 is a cut away side view of an alternate example of the product detector of the invention in a biased state.

Referring now to FIG. 3, a cut away side view of an alternate example of the product detector of the invention in a biased state is shown. The product detector 300 includes a top housing 312, a first seal 313, an indicator cap 314, a probe spring 316, a probe 318, a seal 50, an indicator pin 324 and an indicator spring 326. The product detector 300 is generally cylindrical having a central axis 305.

As in the preferred embodiment, the top housing 312 is preferably constructed of a plastic material. The first seal 313 and second seal 50 preferably comprise rubber. In contrast to the preferred embodiment, the seal 50 may comprise a conventional rubber O-ring or equivalent sealing mechanism. The top housing 312 has a top bore 307 through one side and a bottom bore 309 through the opposite end. The top housing 312 and top and bottom bores 307, 309 are substantially axially disposed around the central axis 305.

The indicator pin assembly 355 is assembled to the top housing 312 so that the indicator button 325 with flared top end 327 protrudes through the top and bottom housing bores 307, 309 respectively. The indicator pin 324 with probe spring 316 and probe 318 are captively engaged in an indicator pin assembly tube 303. The indicator pin assembly tube 303 may be integral with or attached by means, such as a press fit or other known attaching mechanism, to the top housing 312. The indicator cap 314 is positioned in the top bore 307 together with a second biasing means 326. The indicator cap 314 is press fitted, snap fitted or otherwise affixed onto the top flared end of the indicator pin 324. The other end of indicator pin 324 is slid through aperture 341 and held in position by flared bottom end 329. The second biasing means 326 preferably comprises a probe spring having a lower spring constant or spring strength relative to the first biasing means 316 so that the product detector is biased into a biased state with the probe 318 extended.

Figure 4:
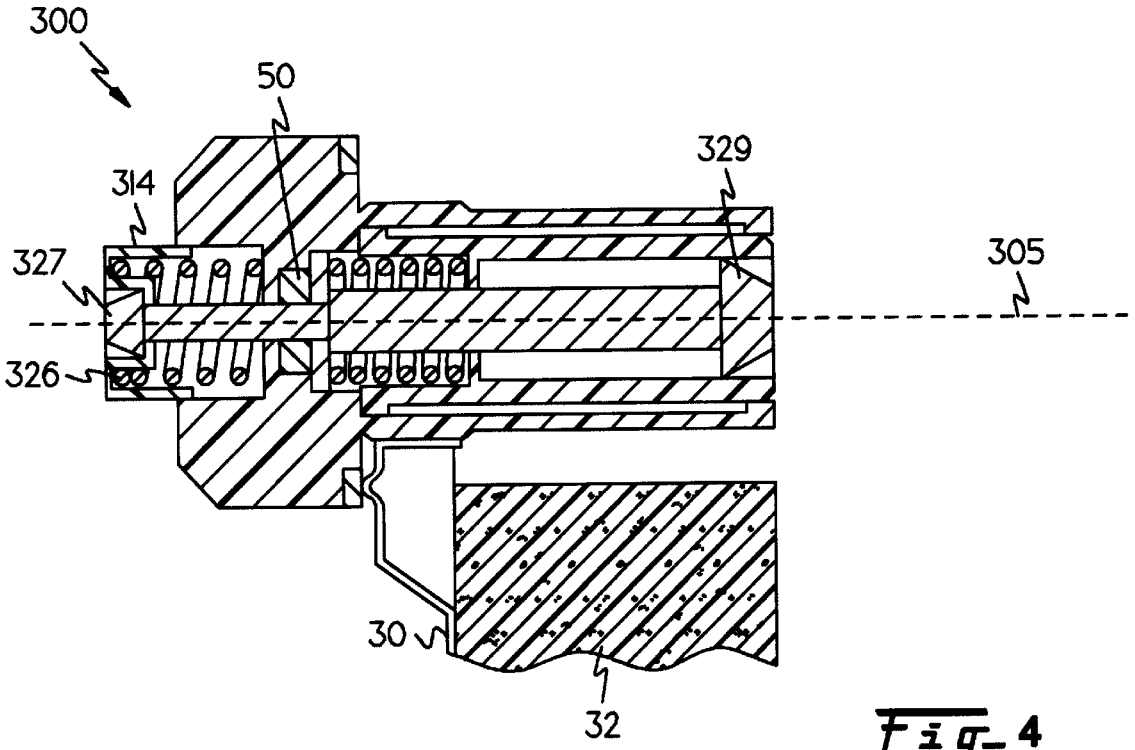
FIG. 4 is a cut away side view of an alternate example of the product detector of the invention in a retracted state.

Referring now to FIG. 4, a cut away side view of an alternate example of the product detector 300 of the invention in a retracted state is shown. The alternate embodiment is constructed and operates substantially similarly to the preferred embodiment of FIG. 1.

Figure 5:
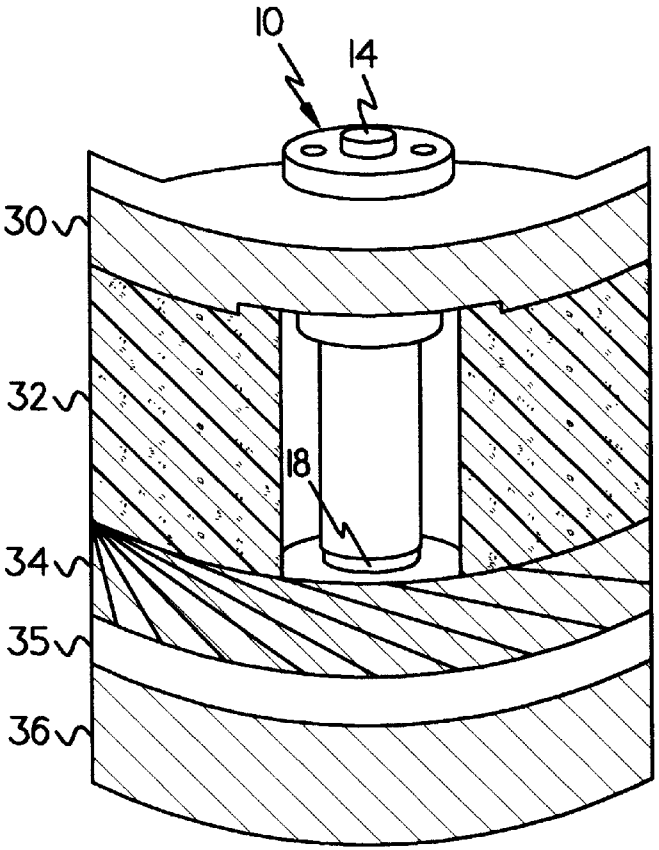
FIG. 5 is a cut away side view of an example of the product detector of the invention deployed in an ammunition canister including a spacer and a cushion.

Referring now to FIG. 5, a cut away side view of an example of the product detector of the invention deployed in an ammunition canister including a spacer and a cushion is shown. The indicator button 14 is extended revealing the presence of a round having a cartridge bottom 36.

Figure 6:
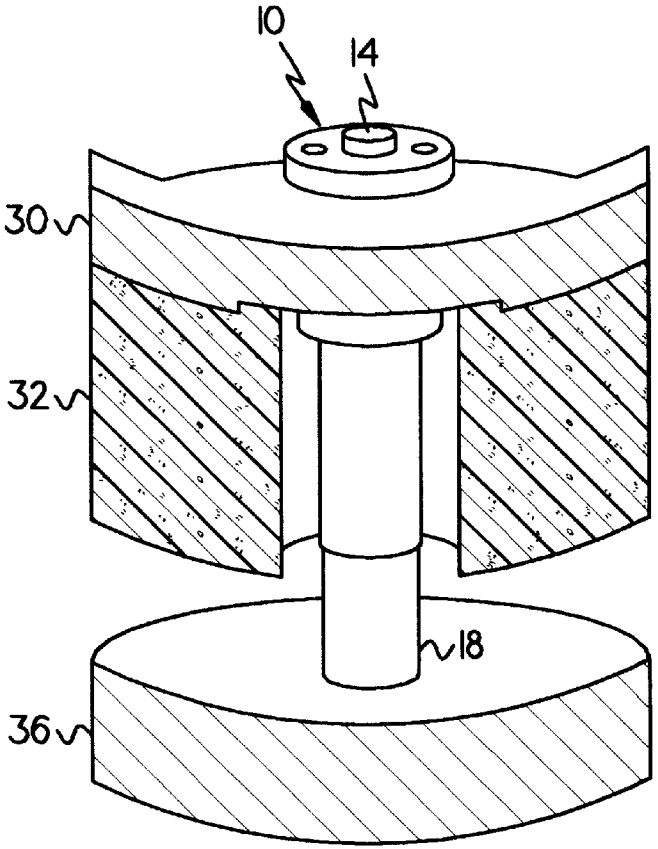
FIG. 6 is a cut away side view of an example of the product detector of the invention deployed in an ammunition canister lacking spacers and cushions.

Referring now to FIG. 6, a cut away side view of an example of the product detector of the invention deployed in an ammunition canister lacking spacers and cushions is shown. Note that, even in the absence of filler material and spacers, the probe 18 is constructed having a suitable length such that it contacts the cartridge bottom end 36. The probe 18 is compressed enough to overcome the biasing effect of the probe spring so that the indicator cap 14 is extended to signal the presence of product.

Figure 8:
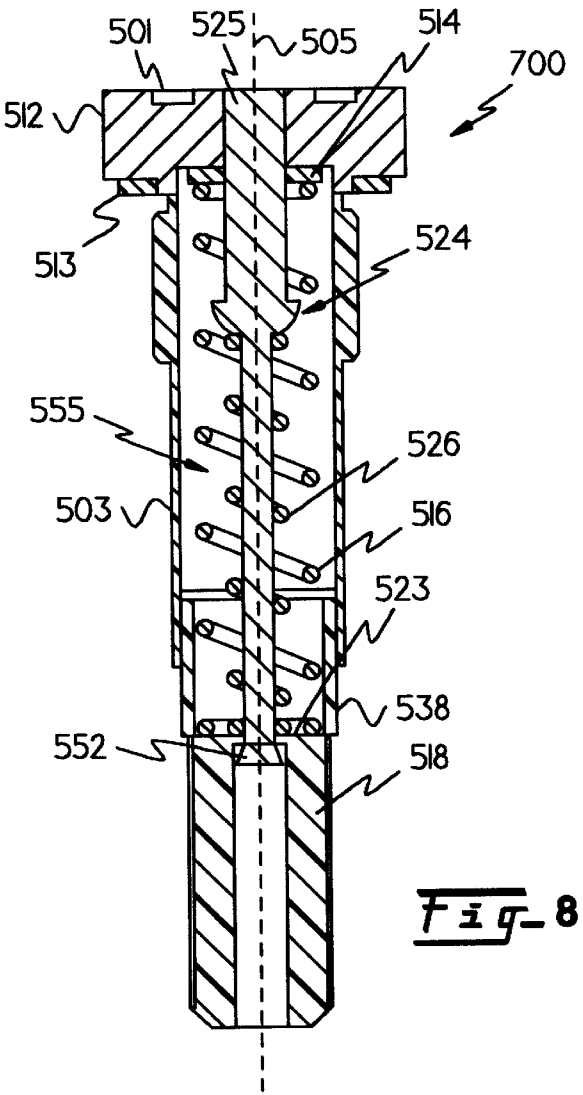
FIG. 8 is a cut away side view of the example of the product detector shown in FIG. 7.
Figure 7:
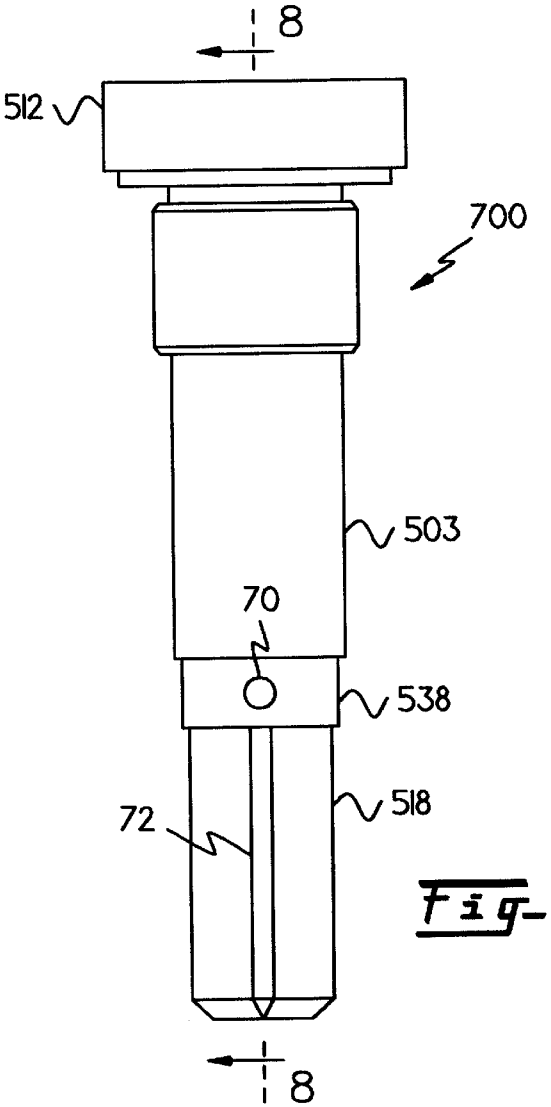
FIG. 7 is a side view of one example of another alternate embodiment of a product detector of the invention in a biased state.

Referring now to jointly to FIG. 7 and FIG. 8, a side view and a cut away side view respectively, of one example of another alternate embodiment of a product detector of the invention in a biased state is shown. A product detector 700 comprises a top 512, a housing 503, and a probe 518. The probe 518 may advantageously be constructed as a cylinder having a pair of opposing grooves 72 therein (For simplicity, only one side is shown). The probe 518 is affixed at a top end 538 to housing 503 by conventional methods. The pair of grooves 72 are sized to be slidably engaged by a complementary pair of guide stakes 70 that prevent the probe 518 from rotating or dislodging.

Figure 9:
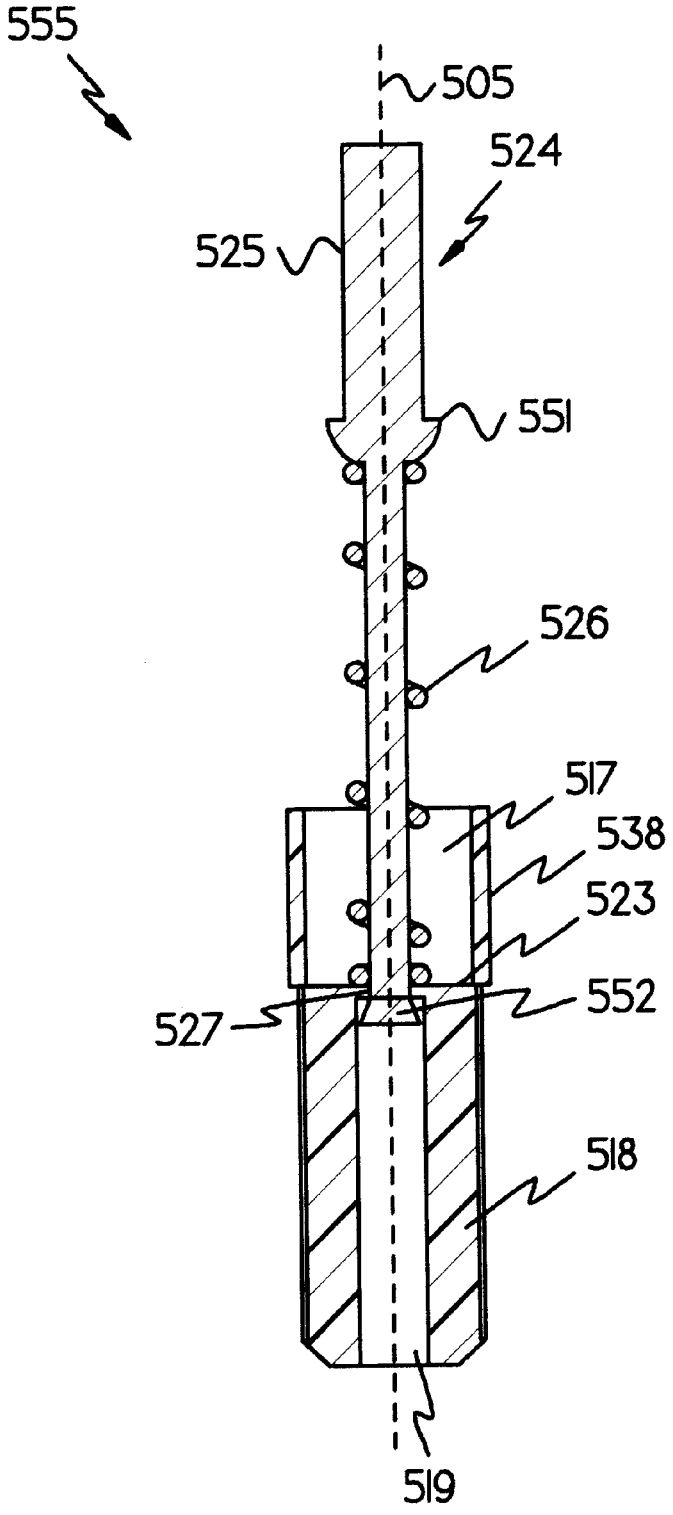
FIG. 9 is a partial cross-sectional side view of one example of an indicator pin assembly constructed in accordance with the present invention.

Referring now again to FIG. 8, the alternate detector 700 includes a first biasing means 516 inserted into housing 503. The first biasing means 516 may advantageously comprise a standard compression spring. An indicator pin assembly 555, best shown in FIG. 9, is contained by housing 503. The first biasing means 516 is held in place between the top 512 and an interior annular surface 523 of probe 518. Retraction of probe 518 due to product contact thus causes the first biasing means 516 to compress, thereby allowing the second biasing means 526 to extend indicator button 525.

Referring now to FIG. 9, a cross-sectional side view of one example of an indicator pin assembly 555 constructed in accordance with an alternate embodiment of the present invention is shown. The indicator pin assembly 555 preferably has a substantially circular cross-section. The indicator pin assembly 555 includes the probe 518. The probe 518 is substantially cylindrical and has a top bore 517 at one end and a bottom bore 519 at a second, opposing end. The top bore 517 stops at surface 523 having an annular aperture 527 therein. The indicator pin 524 includes an integral indicator button 525. The indicator button 525 includes a collar 551 at a proximal end and a flared end 552 at a distal end. The flare end 552 is sized to snap fit into the aperture 527 so that the distal end of the indicator pin is captured within the bottom bore 519 of the probe 518. The indicator pin is also inserted through a second biasing means 526, such as a standard compression spring, where the second biasing means is held between the collar 551 and the surface 523. The first biasing means 516 is held in place between a second seal 514 and interior annular surface 523 of probe 518.

The invention has been described herein in considerable detail in order to comply with the Patent Statutes and to provide those skilled in the art with the information needed to apply the novel principles of the present invention, and to construct and use such exemplary and specialized components as are required. However, it is to be understood that the invention may be carried out by specifically different equipment and devices, and that various modifications, both as to the equipment details and operating procedures, may be accomplished without departing from the true spirit and scope of the present invention.

What is claimed is:

1. A self-contained ammunition round detection unit comprising:

a) an ammunition storage canister having an ammunition storage canister cover;

b) a housing engaged in the ammunition storage canister cover;

c) an indicator mounted within said housing;

d) a probe coupled to said indicator; and e) a dual set of biasing elements captivated within said housing, where said dual set of biasing elements cooperate to retract the indicator in a biased state and extend the indicator to indicate whether an ammunition round is present in the ammunition storage canister when the probe is at least partially retracted by contacting a surface of the ammunition round in the ammunition storage canister.

2. The self-contained ammunition round detection unit of claim 1 wherein said probe has a greater travel than the indicator within the housing and the indicator travels a predetermined distance.

3. The self-contained ammunition round detection unit of claim 1 wherein the indicator is a color indicator.

4. The ammunition round detector of claim 1 wherein said housing includes a top bore and a bottom bore having the indicator recessed in said top bore.

5. An ammunition round detector for indicating presence of an ammunition round in a storage canister, the ammunition round detector comprising:

a) an ammunition storage canister having an ammunition storage canister cover;

b) a top housing including a central axis passing therethrough, where the top housing is engaged in the ammunition storage canister cover, and the top housing includes a top bore and a bottom bore;

c) an indicator cap recessed in said top bore;

d) an indicator pin assembly tube attached to the top housing, where said indicator pin assembly tube has an axis substantially aligned with said top housing central axis;

e) an indicator pin assembly having a top portion and a bottom portion, where said top portion is captively engaged to the top housing, and where the indicator pin assembly further includes, i) an indicator button located at a top end, where the indicator button protrudes through the top bore and the bottom bore and is attached to the indicator cap, ii) a first biasing means, iii) a probe, where the first biasing means and the probe are captively engaged in the indicator pin assembly tube, where the probe is slidingly engaged to the indicator button such that, when the probe is extended in a biased state, the indicator button is also retracted, thereby also retracting the indicator cap, iv) a second biasing means captivated within said indicator cap; and f) wherein the first biasing means and second biasing means cooperate to retract the indicator cap and extend the probe in the biased state so as to indicate the absence of an ammunition round in the ammunition storage canister, and extend the indicator cap when the probe is at least partially retracted when contacting a surface of an ammunition round state so as to indicate the presence of an ammunition round in the ammunition storage canister.

6. The ammunition round detector of claim 5 wherein said indicator pin assembly tube is attached by means of a press fit attaching mechanism to the top housing.

7. The ammunition round detector of claim 5 wherein a seal is inserted into the bottom bore and held in place by the indicator pin assembly tube.

8. The ammunition round detector of claim 5 wherein the indicator cap is press fitted or snap fitted onto the top flared end of the indicator pin.

9. The ammunition round detector of claim 5 wherein the second biasing means comprises a probe spring having a lower spring constant or spring strength relative to the first biasing means.

10. The ammunition round detector of claim 5 wherein the indicator pin has a first flared end coupled to said indicator cap.

11. The ammunition round detector of claim 5 wherein the indicator pin has a second flared end located within said probe.

12. The ammunition round detector of claim 5 wherein said probe has a first probe bore and a second probe bore, wherein the indicator pin has a second flared end located within said second probe bore, and where said first biasing means and said second biasing means are at least partially captively positioned within said first probe bore.

13. The ammunition round detector of claim 5 further including a seal enclosed within said bottom bore.

14. The ammunition round detector of claim 13 wherein said seal comprises a rubber seal.

15. An ammunition round detector for indicating presence of an ammunition round in a storage canister, the ammunition round detector comprising:

a) an ammunition storage canister having an ammunition storage canister cover;

b) a top housing including a central axis passing therethrough, where the top housing is engaged in the ammunition storage canister cover, and the top housing includes a bore therethrough;

c) an indicator pin assembly tube attached to the top housing, where said indicator pin assembly tube has an axis substantially aligned with said top housing central axis;

d) an indicator pin assembly having a top end and a bottom end, where said top end includes an indicator button and is slidingly engaged to the top housing through the top housing bore, and where the indicator pin assembly further includes, i) a first biasing means, ii) a probe, where the first biasing means and the probe are captively engaged in the indicator pin assembly tube, where the probe is slidingly engaged to the indicator button such that, when the probe is extended in a biased state, the indicator button is retracted, iii) a second biasing means captivated between said indicator button and said probe; and e) wherein the first biasing means and second biasing means cooperate to retract the indicator button and extend the probe in the biased state so as to indicate the absence of an ammunition round in the ammunition round canister, and extend the indicator button when the probe is at least partially retracted by contacting a surface of the ammunition round state so as to indicate the presence of an ammunition round in the ammunition round canister.

16. The ammunition round detector of claim 15 wherein said indicator pin assembly tube is attached by means of a press fit attaching mechanism to the top housing.

17. The ammunition round detector of claim 15 wherein the second biasing means comprises a probe spring having a lower spring constant or spring strength relative to the first biasing means.

18. The ammunition round detector of claim 15 wherein the indicator pin has a first end comprising an indicator cap.

19. The ammunition round detector of claim 15 wherein the indicator pin has a second flared end located within said probe.

20. The ammunition round detector of claim 15 wherein said probe has a first probe bore and a second probe bore, wherein the indicator pin has a second flared end located within said second probe bore, and where said first biasing means and said second biasing means are at least partially captively positioned within said first probe bore.

* * * * *